United States Patent [19]

Mugnier

[11] Patent Number: 4,779,890

[45] Date of Patent: Oct. 25, 1988

[54] EQUIPMENT FOR A MONOSKI

[76] Inventor: Georges Mugnier, Morillon 74440 - Taninges, France

[21] Appl. No.: 2,401

[22] PCT Filed: Apr. 16, 1986

[86] PCT No.: PCT/EP86/00233

§ 371 Date: Dec. 17, 1986

§ 102(e) Date: Dec. 17, 1986

[87] PCT Pub. No.: WO86/06287

PCT Pub. Date: Nov. 6, 1986

[30] Foreign Application Priority Data

Apr. 19, 1985 [FR] France ..... 85 06456

[51] Int. Cl.[4] ..... A63C 9/00

[52] U.S. Cl. ..... 280/607; 280/601

[58] Field of Search ..... 280/601, 607, 600, 618, 280/636, 818, 12 H; 441/67, 68

[56] References Cited

U.S. PATENT DOCUMENTS

| | | | |
|---|---|---|---|
| 3,947,049 | 3/1976 | Pedersen | 280/607 |
| 4,028,760 | 6/1977 | Tarlton | 280/607 |
| 4,227,274 | 10/1980 | Richardson | 441/68 |
| 4,275,904 | 6/1981 | Pedersen | 280/601 |
| 4,627,636 | 9/1986 | Payraud | 280/607 |
| 4,674,765 | 6/1987 | Powell | 280/607 |

FOREIGN PATENT DOCUMENTS

| | | |
|---|---|---|
| 0063179 | 10/1982 | European Pat. Off. . |
| 1539207 | 8/1968 | France . |
| 2439030 | 5/1980 | France . |
| 2546764 | 12/1984 | France . |

*Primary Examiner*—Richard A. Bertsch

*Attorney, Agent, or Firm*—Robert E. Burns; Emmanuel J. Lobato

[57] ABSTRACT

A monoski has at least one pilot ski, the dimensions of which are inscribed within the perimeter of the monoski, releasably attached on the face of the monoski opposite the sliding face by means of a stop located on the same side as the heel of the pilot ski, a sling-shaped elastic loop located on the same side as the tip of the pilot ski, the two fastening points of the elastic loop being located on either side of the pilot ski at a sufficient distance from the stop to ensure that the elastic force exerted by the elastic loop keeps the heel of the pilot ski firmly against the stop, and at least one strap which straddles the pilot ski and holds it against the monoski.

4 Claims, 1 Drawing Sheet

EQUIPMENT FOR A MONOSKI

The invention relates to the means used for practising winter sports, particularly to equipment for a monoski or twin skis.

Since the main aim of using a monoski is to descend a slope, it is essential to climb to a high point before preparing to descend it.

The user of a monoski cannot put it on until he leaves the car of a cableway or a chair-lift seat which has carried him to the top of the slope; he is prohibited from being towed by a ski-lift with poles for obvious reasons of safety, as much for his own sake as for that of the other skiers wearing separate skis.

The purpose of the equipment according to the invention is to allow the user of a monoski to be towed by a ski-lift with poles, by guiding the monoski with one foot, a pilot ski being worn on the other foot.

This equipment is characterized in that at least one pilot ski, the dimensions of which are inscribed within the perimeter of the face of the monoski opposite the sliding sole and which is fitted with a safety fastening, is arranged removably on the said face of the monoski being held in place by quick-release means, and in that the pilot ski can easily be detached from its support for parallel use in accompaniment, thus making it easier to guide the assembly consisting of the monoski and pilot ski.

The means used to hold a pilot ski on the monoski comprise at least three elements, namely a hook-shaped stop located on the same side as the heel of the pilot ski, a sling-shaped elastic loop located on the same side as the tip of the pilot ski, the two fastening points for the loop being arranged on either side of the pilot ski at a sufficient distance from the stop to ensure that the elastic force exerted by the pocket of the sling on the tip of the pilot ski keeps its heel effectively up against the stop, and at least one strap which straddles the pilot ski and the function of which is to lay the pilot ski against the face of the monoski opposite the sliding sole.

In another embodiment, the monoski has, on its face opposite the sliding sole, two imprints parallel to its edges and having exactly the dimensions of two standard skis duly fitted with safety fastenings, suitable means keeping the two skis firmly in the imprints of the monoski, whilst at the same time allowing the standard skis to be separated quickly from the monoski.

The main advantages of such monoski equipment are that slopes can be climbed in ways other than by the sole means of cableways with cabins or other chair-lift systems.

Other advantages will emerge from the description of embodiments given by way of non-limiting examples and from the drawing in which.

Figures 1, 2:
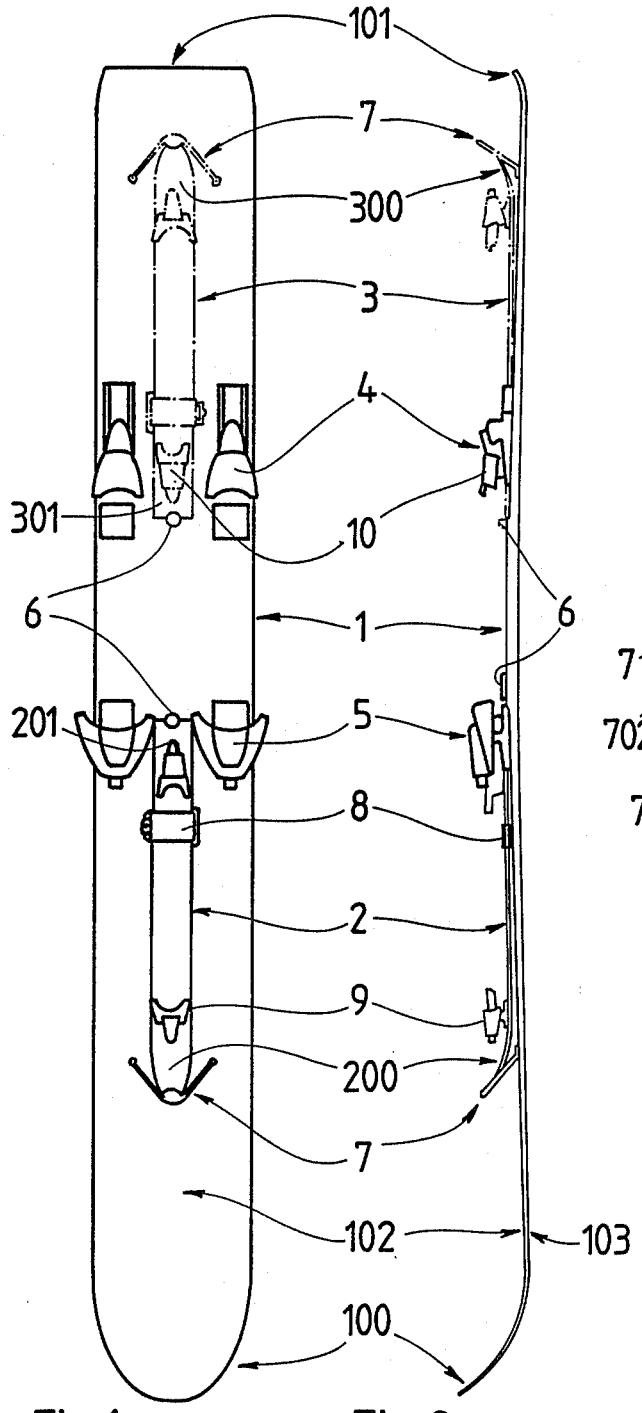
FIG. 1 is a plan view of a monoski equipped with one or two pilot skis.
FIG. 2 is a profile view of the monoski of FIG. 1.

The monoski 1 illustrated in FIGS. 1 and 2 has a pilot ski 2 located between the front fastenings 5 and the tip 100 of the monoski. It also has a position for a second pilot ski 3, represented by dotted lines, located between the rear fastenings 4 and the heel 101 of the monoski 1.

The pilot skis 2, 3 are held against the face 102 of the monoski opposite the sliding sole 103 by at least three means interacting with one another, namely a stop 6 against the heel 201, 301 of the pilot ski 2, 3;

a sling-shaped loop 7 exerting an elastic force F (FIG. 3) on the tip 200, 300 of the pilot ski in order to push it against the stop 6;

at least one strap 8 which lays the pilot ski 2, 3 against the face 102 of the monoski.

In general terms, to prevent the pilot ski from shifting the center of gravity of the assembly comprising the monoski and pilot ski, the heel 201, 301 of the pilot ski 2, 3 is placed between the rear fastenings 4 and front fastenings 5 of the monoski. In fact, the rear part of the pilot ski 2, 3, that it to say the heel 201, 301 supporting the rear fastening 10 of the pilot ski 2, 3, is heavier than the front part.

Figure 3:
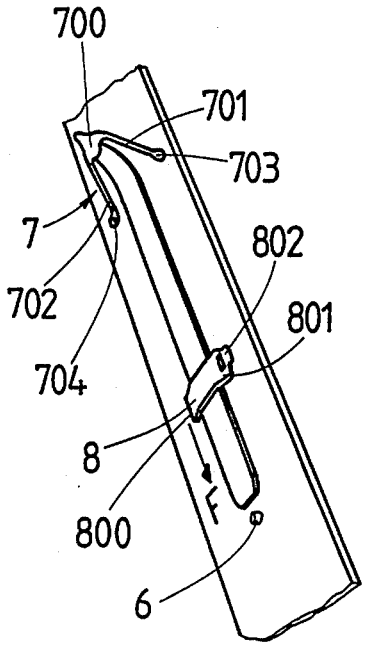
FIG. 3 is a partial view of the means of fastening a pilot ski to the monoski.

FIG. 3 shows in detail these three means of fastening the pilot ski.

The stop 6 has a notch (not shown) into which the heel 201, 301 of the pilot ski 2, 3 penetrates under the effect of the elastic force F.

The sling 7 has a pocket 700, into which the end of the tip 200, 300 is introduced; the two elastic strands 701, 702 of the sling 7 are fastened, at the end of their free part, to the monoski at two points 703, 704 located on either side of the tip 200, 300 of the pilot ski 2, 3.

The strap 8 is fastened to the monoski at its two ends 800, 801, at least one 801 being provided with a turn-down clip 802 which ensures that it is tensioned on the pilot ski 2, 3.

Each pilot ski 2, 3 has a fastening in two parts, namely a front part 9 and a rear part 10, possessing the same safety devices as the front and rear fastenings 5, 4 of the monoski. Each pilot ski 2, 3 is arranged on the monoski in such a way that its fastenings 9, 10 do not prevent the action of the safety devices for the fastenings 4, 5 of the monoski the event of a fall.

In another embodiment with only one pilot ski, the latter is placed flat on its sliding sole between the fastenings 4, 5 of the monoski. The means 6, 7, 8 used to hold this pilot ski in place are arranged on either side of these fastenings 4, 5.

In another embodiment, again with only one pilot ski, the latter is placed on edge between the fastenings 4, 5 of the monoski; it is held in place by means of at least two elastic straps 8 having a quick-release device and arranged on either side of the fastenings 4, 5.

In another embodiment, the monoski has no fastenings for independent use, but, in its thickness and open onto the face opposite the sliding sole, two imprints which are parallel to the edges of the monoski and in which are placed two standard skis equipped with their fastenings together with safety devices.

The imprints each receive a standard ski which they grip exactly without either lateral or longitudinal play, since they have the same dimensions as these skis in terms of width and length, at least between the heel and the start of the tip, their depth being at least equal to half the thickness of these skis.

The means used to retain the standard skis in the imprints of the monoski comprise several transverse straps which are distributed over the length of the standard skis and on one side are fastened to one edge of the face of the monoski opposite the sliding sole, and which pass over each standard ski fitted in its imprint, being tensioned on these standard skis by means of a lever clamp fastened to the other edge of the monoski.

Catches which can be turned down perpendicularly to each strap are fastened to the monoski between the imprints, in order to maintain the tension of each strap on the standard skis.

To climb a slope, the skier releases the said straps, without taking off his standard skis, and can thus climb up with his skis or use a pole-type ski-lift, after putting on his back the lightened monoski free of fastenings.

In another embodiment of the monoski with imprints, the means used to retain the standard skis in the imprints comprise a device with slides.

These parallel slides of a known type are continuous or discontinuous and are arranged along the edges of the imprints, the distance between them and their height in relation to the bottom of the imprint correspondino to the dimensions of the standard skis introduced between them.

Since the width and thickness of standard skis are most frequently variable between the heel and the tip, the preferred means comprise studs distributed in pairs facing one another along the edges of each imprint.

A quick-release catch connects each pair of studs in order to retain the standard skis in the imprints effectively.

To make it easier to introduce the standard skis between the studs, the latter comprise rollers which rotate about a shaft inclined towards the axis of the imprint in relation to the plane of the face of the monoski opposite the sliding sole.

This inclination reinforces the pressure exerted by the studs on the standard skis and makes it possible to limit the number of catches.

The action of the catch or catches connecting the studs is further reinforced by equipping each standard ski with at least one lug arranged on its face opposite the sliding sole, so that it penetrates into a corresponding orifice in the catch turned down onto the ski.

I claim:

1. Equipment for a monoski or twin skis, characterized in that at least one pilot ski, the dimensions of which are inscribed within the perimeter of the face of the monoski opposite the sliding sole and which is equipped with a fastening, is arranged removably on the said face of the monoski and held in place by at least one means of attachment and release, and in that the pilot ski can easily be detached from its support for parallel use in accompaniment, thus making it easier to guide the assembly comprising the monoski and pilot ski, for example when a ski-lift with poles tows a skier wearing the monoski on one foot and the pilot ski on the other foot, said means of attachment and release comprising three elements, namely a stop (6) located on the same side as the heel (201, 301) of the pilot ski, a sling-shaped elastic loop (7) located on the same side as the tip (200, 300) of the pilot ski, the two fastening points (703, 704) for the strands (701, 702) holding the pocket (700) of the loop being located on either side of the pilot ski at a sufficient distance from the stop to ensure that the elastic force (F) exerted by the pocket of the sling on the tip of the pilot ski keeps its heel effectively up against the stop, and at least one strap (8) which straddles the pilot ski and the function of which is to lay it against the face of the monoski opposite the sliding sole.

2. Monoski equipment according to claim 1, characterized in that the means (6, 7, 8) used to retain a pilot ski on the monoski are arranged on either side of the fastenings (4, 5) of the monoski.

3. Monoski equipment according to claim 1, characterized in that the means (6, 7, 8) used to retain a pilot ski are located in front of the fastenings (4, 5) of the monoski between these fastenings and the tip (100) of the monoski.

4. Monoski equipment according to claim 1, characterized in that the means (6, 7, 8) used to retain a pilot ski are located behind the fastenings (4, 5) of the monoski between these fastenings and the heel (101) of the monoski.

* * * * *